US007647732B2

(12) United States Patent
Rickards et al.

(10) Patent No.: US 7,647,732 B2
(45) Date of Patent: Jan. 19, 2010

(54) DECORATIVE SLAB CORNER FASTENER

(76) Inventors: John W. Rickards, 3452 Hancock St., San Diego, CA (US) 92110; Dan Davis, 1336 Ocean Ave., Del Mar, CA (US) 92014

( * ) Notice: Subject to any disclaimer, the term of this patent is extended or adjusted under 35 U.S.C. 154(b) by 126 days.

(21) Appl. No.: 11/435,087

(22) Filed: May 15, 2006

(65) Prior Publication Data

US 2007/0261331 A1 Nov. 15, 2007

(51) Int. Cl.
*E04H 13/00* (2006.01)

(52) U.S. Cl. ..... 52/139; 52/509; 52/137

(58) Field of Classification Search ..... 52/137, 52/139, 235, 509; 47/41.01, 41.12, 83; 411/338; D11/382

See application file for complete search history.

(56) References Cited

U.S. PATENT DOCUMENTS 712,824 A * 11/1902 Masland ..... 211/65
1,226,101 A * 5/1917 Marsden ..... 248/315
1,970,370 A * 8/1934 Foser ..... 47/41.01
2,074,248 A * 3/1937 Barbour ..... 248/108
2,080,190 A * 5/1937 Sinner ..... 52/698
2,574,938 A * 11/1951 Sinner ..... 52/378
3,181,664 A 5/1965 Aagaard
3,213,576 A * 10/1965 Davies ..... 52/134
3,342,005 A * 9/1967 Rickards ..... 52/702
3,553,888 A * 1/1971 Daly et al. ..... 47/41.1
3,778,942 A * 12/1973 Bondi ..... 52/134
3,828,508 A 8/1974 Moeller
3,905,169 A * 9/1975 Gallo ..... 52/137
3,990,199 A * 11/1976 Gallo ..... 52/137
4,021,989 A 5/1977 Hala
4,190,157 A * 2/1980 Chatham ..... 206/477
4,484,422 A * 11/1984 Roberts ..... 52/137
4,519,173 A * 5/1985 Roberts ..... 52/235
4,523,413 A * 6/1985 Koppenberg ..... 52/139
4,545,167 A * 10/1985 Brock ..... 52/509
4,638,618 A 1/1987 Iesaka et al.
4,644,711 A 2/1987 Eickhof
4,724,643 A 2/1988 Marsh
4,803,823 A 2/1989 Stenson
5,085,002 A * 2/1992 Lee et al. ..... 47/41.12
5,138,809 A 8/1992 Saikachi
5,280,690 A 1/1994 Hu
5,419,091 A * 5/1995 Roberts ..... 52/509
D365,041 S * 12/1995 Dollinger ..... D11/146
5,609,259 A * 3/1997 Menard ..... 211/66
5,894,699 A 4/1999 Fulton et al.
5,953,865 A * 9/1999 Rickards ..... 52/139
D440,733 S * 4/2001 Williams et al. ..... D99/19
D447,084 S * 8/2001 Markley ..... D11/148

(Continued)

*Primary Examiner*—Brian E Glessner
*Assistant Examiner*—James J Buckle, Jr.
(74) *Attorney, Agent, or Firm*—Charmasson, Buchara & Leach, LLP

(57) ABSTRACT

A device for releasably fastening up to four adjacent slab corners to a support wall or ceiling. The device is positioned at a common point of adjacency of a number of slabs. A locking disk having a quadrant notch is rotatively mounted orthogonally to the surface of the slabs, and engages or disengages slots cap in the thickness of the slabs according to the angular orientation of the disk. The device is capped by a decorative rosette having an appendage projecting loop bracket shaped and dimensioned to accommodate a bud vase. The device is particularly indicated for fastening slabs used to cover adjacent funerary crypts.

14 Claims, 2 Drawing Sheets

U.S. PATENT DOCUMENTS 6,457,592 B1 * 10/2002 Rozen ..... 211/65
6,564,514 B1 * 5/2003 Rickards ..... 52/139
6,904,714 B1 * 6/2005 Chen ..... 47/41.01
2004/0128755 A1 * 7/2004 Loberger et al. ..... 4/642
2005/0012006 A1 * 1/2005 O'Donoghue ..... 248/294.1
2006/0185074 A1 * 8/2006 Loberger et al. ..... 4/642

* cited by examiner

DECORATIVE SLAB CORNER FASTENER

FIELD OF THE INVENTION

This invention relates to wall and ceiling fasteners, and more particularly to fasteners used for releasably holding crypt covers in mausoleums.

BACKGROUND

I have disclosed in my prior U.S. Pat. Nos. 5,953,865 and 6,564,514 various types of fasteners particularly indicated for locking a number of adjacent cover slabs to walls or ceilings. These fasteners have been particularly useful in the construction of funerary chambers where caskets, crypts and urn niches are formed in a wall, each covered by a marble or granite slab cover. The fastener comprises a rotatable disk, having a quadrant notched away mounted on a shaft perpendicular to the plane of the slabs at the spot where the corners of two or more slabs meet. Depending upon the angular orientation of the disk, engages or disengagement from slots cut in the thickness of the slabs.

In an attempt to provide a certain amount of play in the orientation of the disk in order to accommodate unevenness in the position and orientation of the slots, ingenious but complex mechanisms have been devised which tend to complicate the installation and increase the cost of the device. Moreover, the outer end of the bolt which remains visible at the corner point of the slabs can be unsightly.

The present invention results from an attempt to remedy the aforesaid defects and disadvantages.

SUMMARY

The instant embodiments offer a simplified corner fastener for slabs which allow a great flexibility of position adjustments as well as convenient accommodations of minor dimensional inconsistencies in the thickness of the slabs and the position of their attachment slots.

Some embodiments resolve the aesthetic defect of the prior art fastener by providing a decorative rosette to cover the corner point and offer an additional use of the fastener as a support for the type of bud vase or flower bracket which is commonly applied to the niche and crypt covers.

Some embodiments essentially consist of a releasable fastener to secure to a supporting structure, a corner portion of each of a plurality of corner-adjacent cover slabs that are held in a common plane, and comprise a mounting member and means for securing the mounting member to the supporting structure, bolt of a given cross-section diameter projecting from the mounting member orthogonally to the plane or the slabs, a notched disk mounted on the bolt and being shaped and positioned to engage and disengage a slot cut parallel to the plane of the slabs in the corner of each of the slabs according to angular orientations of disk, some means for resiliently allowing a limited multi-directional movement of the disk in relation to the mounting member, and a decorative rosette secured to one end of the bolt opposite the mounting member.

In some embodiments the rosette comprises a means for holding a container in the form of a loop bracket projecting outwardly from the rosette and defining a central opening shaped and dimensioned to engage a bud vase or the stems of a small bunch of flowers.

In some embodiments the means allowing for a movement of the bolt comprise a resiliently compressible bearing which secures the bolt to the mounting member.

In some embodiments the mounting member allows for two dimensional adjustment of the bolt and disk in relation to the supporting structure.

In some embodiments the supporting member comprises a backplate which is adjustably securable to the supporting structure along a first axis, and a front plate adjustably securable to the backplate along a second axis perpendicular to the first axis.

In some embodiments the backplate has at least one elongated opening oriented along the first axis and at least one elongated aperture oriented along the second axis.

In some embodiments a first fastener engaged into the opening secures the backplate to the supporting structure.

In some embodiments a second fastener engaged into the aperture and into a bore through the front plate secures the front plate to the second plate.

In some embodiments the second fastener comprises a head which is held behind the backplate, and a stem projecting from the head through the aperture. In some embodiments the aperture comprises a narrow section having a width lesser than that of the head and an enlarged section having a width greater than that of the head whereby the head may be passed through the opening after the backplate has been fastened to the supporting structure.

In some embodiments the movement of the bolt in relation to the support structure is further facilitated by the bore in the front plate having a diameter about 10 percent larger than the cross-section diameter of the bolt.

In some embodiments a compressible bearing secures the head end of the bolt to the front plate and the bolt has an opposite threaded end.

In some embodiments a nut screwed upon the threaded end of the bolt has a key which engages a keyed hole in the disk causing the disk to rotate when the nut is rotated.

In some embodiments the nut extends radially into a decorative rosette and comprises an indicator of the angular position of the disk.

DESCRIPTION OF THE PREFERRED EMBODIMENTS

Figure 1:
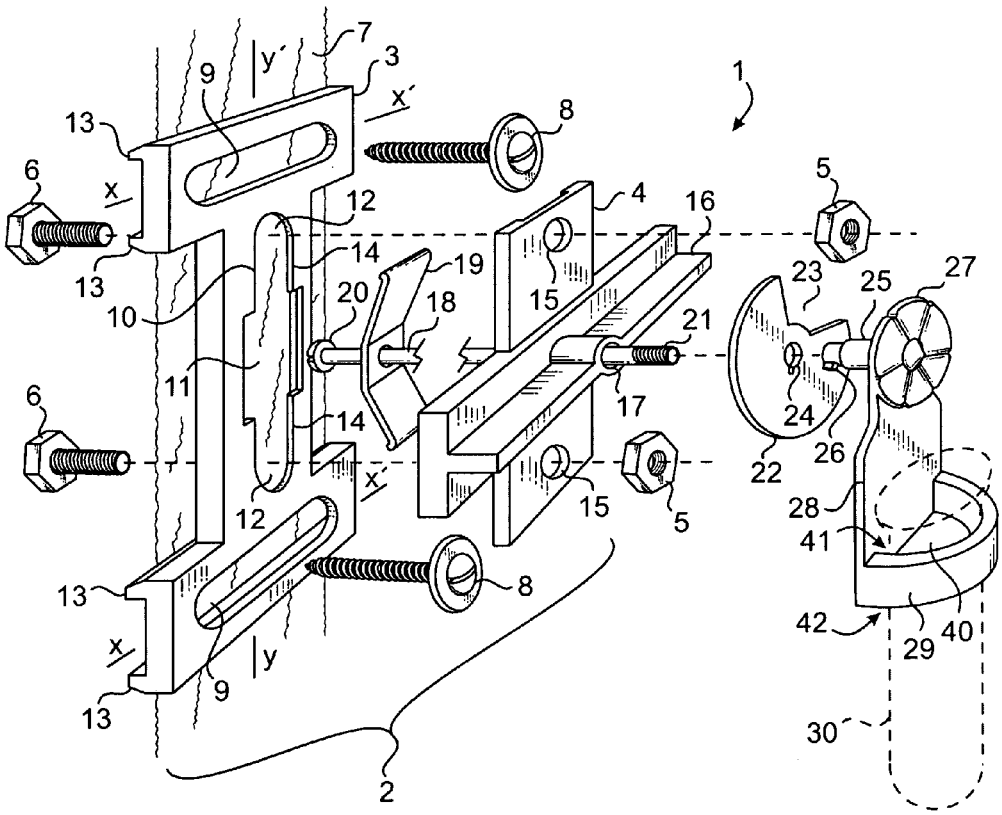
FIG. 1 is a perspective exploded view of the fastening device according to the exemplary embodiments.
Figure 2:
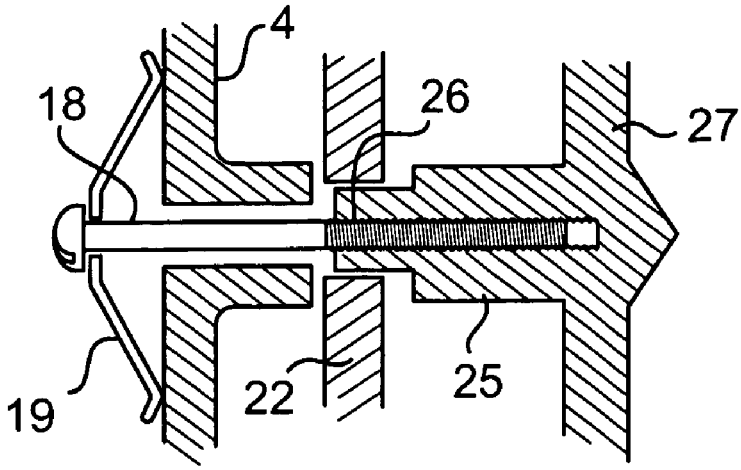
FIG. 2 is a detailed cross-sectional view of the bolt assembly.

Referring now to the drawing, there is shown a slab corner fastening device according to one or more exemplary embodiments of the invention. This exemplary embodiment constitutes an improvement over the devices disclosed in U.S. Pat. Nos. 5,953,865 and 6,564,514. These two patents are incorporated in this specification by this reference.

The fastening device 1 comprises a mounting member 2 made of a backplate 3 and a front plate 4 secured to the backplate by a pair of nuts 5 and bolts 6 combinations.

The backplate is first secured to a wall stud 7 or other supporting structure by a pair of washer-backed screws 8 passing through elongated openings 9, each oriented along an horizontal axis X-X'. The backplate also has an elongated aperture 10 oriented along a vertical axis Y-Y'. This aperture has an enlarged median portion 11 having a width greater than the width of the heads of the bolts 6. Two narrow portions 12 astride the enlarged portion have a width lesser than the width of the heads of the bolts 6. Ribs 13 projecting inwardly from the back of the backplate provide enough clearance between the rims 14 of the narrowed portion and the supporting structure 7 to accommodate the thickness of the heads of the bolts 6. Consequently, in order to install the front plate to the already installed back plate, the bolts are introduced behind the narrowed portions 12 of the aperture by pushing them first through the enlarged portion 11 then moved apart respectively toward the narrowed portions before their stems are engaged through bores 15 in the front plate 4. It can now be understood that the position of the device can be adjusted along two substantially orthogonal directions, first laterally by adjusting the position of the screws 8 within the openings 9, and vertically by adjusting the position of the front plate in relation to the back plate and that of the bolts 6 within the aperture 10. Projecting perpendicularly and outwardly from the front plate 4 is a shelf 16 designed to support a pair, of slab covers as will be explained below. A central bore 17 in the front plate is engaged by a rotatable bolt 18. The rotatable bolt penetrates the central bore from the back of the front plate, after passing through a compressible bearing 19 adjacent to the head 20 of the bolt 18. The compressible bearing consists of a dual leaf spring, but could also be constituted by an elastomeric washer or bushing, or any similar device that can allow a resilient axial movement of the bolt when compressed as well as small deflections around the normal axial orientation of the bolt. The central bore 11 of the front plate has a diameter which is about 10 percent larger than the cross-diameter of the rotatable bolt 18. Accordingly, due to its flexible and compressible bearing 19, the rotatable bolt is allowed a certain degree of wobbling within the central bore 17. The opposite, proximal end of the bolt 21 is threaded and first engages a disk 22 of which a quadrant 23 has been notched off. The bolt end engages the disk through a keyed hole 24. A capping nut 25 has a radial key 26 shaped and dimensioned to fit into the keyed hole 24 of the disk when the capping nut is fully screwed upon the threaded end 21 of the rotatable bolt. The capping nut 25 expands radially to form a decorative rosette 27. It should also be understood that the rosette could be an attachment mounted on the capping nut. An appendage 28 to the rosette comprises a loop bracket 29 defining a substantially vertical passageway 40 having top and bottom openings 41, 42, where the passageway is shaped and dimensioned to engage and hold a bud vase 30 shown in dotted lines or the stems of a small bunch of flowers.

Figure 3:
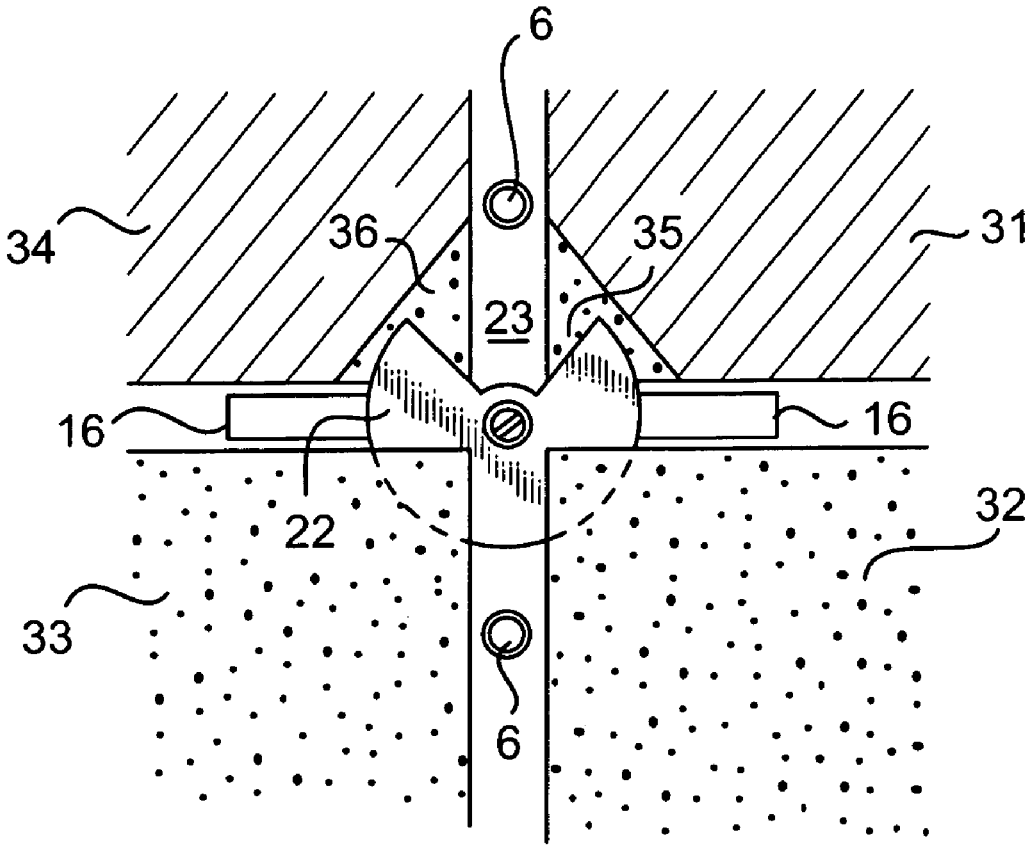
FIG. 3 is a frontal view of four slab corner junctions secured by the fastening device.

As illustrated in FIG. 3, four corner-adjacent cover slabs 31-34 can be secured by the fastening device 1 to a supporting structure. The two upper slabs 31, 34 are shown in cross-section about a plane passing through slots 35, 36 cut across their thickness. That plane is perpendicular to the surface of the slabs. These two upper slabs rest on the shelf 16. As the disk 22 is rotated, its notched quadrant 23 will sequentially engage and disengage each corner slot allowing selective installation or removing of each slab. The rosette, disk and bolt are preferably always rotated clockwise to prevent disengagement of the capping nut from the rotatable bolt.

The appendage 28 acts as a crank-handle to turn the disk 22, and as a pointer or indicator of its angular position. The keyed hole 24 is oriented to place the disk in the locking position shown in FIG. 3 when the appendage 28 is in its resting downward position illustrated in FIG. 1.

It should be also be understood that the appendage and loop bracket can be provided separately from the rosette with or without connection to the capping nut thereby providing greater interchangeability options and functionality. For example owners may not wish to allow the visiting public to have the ability to rotate the disk without tools.

While the preferred embodiment of the invention has been described, modifications can be made and other embodiments may be devised without departing from the spirit of the invention and the scope of the appended claims.

What is claimed is:

1. A device, for releasably fastening to a supporting structure, a corner portion of each of a plurality of corner-adjacent cover slabs held in a common plane, which comprises:

a mounting member;

means for securing said member to said structure;

a bolt of a given cross diameter projecting from said member orthogonally to said plane;

a notched disk mounted on said bolt and being shaped and positioned to engage and disengage, according to angular orientation of said disk, a slot cut parallel to said plane in a corner of each of said slabs;

means for resiliently allowing a limited multi-directional movement of said disk in relation to said member; and means for turning said disk and for indicating said disk's angular position, said means comprising a decorative rosette secured to said disk at one end of said bolt opposite said member;

and including an appendage projecting radially from said rosette.

2. The device of claim 1, wherein said means for allowing comprises a resiliently compressible bearing securing said bolt to said member.

3. The device of claim 1, which further comprises means for adjusting the position of said bolt parallel to said plane in relation to said structure.

4. The device of claim 3, wherein said member comprises:

a backplate adjustably securable to said structure along a first axis; and a front plate adjustably securable to said backplate along a second axis substantially perpendicular to said first axis.

5. The device of claim 4, wherein said backplate has at least one elongated opening oriented along said first axis.

6. The device of claim 4, wherein said backplate has at least one elongated aperture oriented along said second axis.

7. The device of claim 5 which further comprises a fastener engaged into said opening for securing said backplate to said structure.

8. The device of claim 6 which further comprises a second fastener engaged into said aperture and through a bore in said front plate.

9. The device of claim 8, wherein:

said second fastener comprises a head held behind said backplate and a stem projecting from said head through said aperture; and said aperture comprises a narrow section having a width lesser than said head and an enlarged section having a width greater than said head;

whereby said head may be inserted behind said backplate while said backplate is fastened to said structure.

10. The device of claim 8, wherein said means for adjusting further comprises said bore having a diameter about 10 percent larger than the cross-section diameter of said bolt.

11. The device of claim 4, wherein:

said bearing secures said bolt to said front plate; and said bolt has a head at one end adjacent to said bearing and a threaded opposite end.

12. The device of claim 11 which further comprises:

a nut screwed upon said threaded end;

said disk has a keyed hole engaged by said bolt; and said nut comprises a key shaped and dimensioned to engage said keyed hole;

whereby rotation of said nut brings about rotation of said disk.

13. The device of claim 12, wherein said nut mounts said rosette.

14. The device of claim 1, wherein said appendage comprises a loop bracket defining a passageway shaped and dimensioned to engage a bud vase.

* * * * *